US008760265B2

(12) United States Patent
Krueger

(10) Patent No.: US 8,760,265 B2
(45) Date of Patent: Jun. 24, 2014

(54) REMOTE CONTROL SIGNAL LEARNING AND PROCESSING BY A HOST DEVICE AND ACCESSORY

(75) Inventor: Scott Krueger, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 398 days.

(21) Appl. No.: 12/437,947

(22) Filed: May 8, 2009

(65) Prior Publication Data

US 2010/0283624 A1 Nov. 11, 2010

(51) Int. Cl.
*G08C 19/16* (2006.01)

(52) U.S. Cl.
USPC ..... 340/12.23; 340/12.24; 340/4.11

(58) Field of Classification Search
USPC ..... 340/825.72, 12.29, 12.23, 12.24, 4.11
See application file for complete search history.

(56) References Cited

U.S. PATENT DOCUMENTS

| | | | | |
|---|---|---|---|---|
| 4,567,557 | A * | 1/1986 | Burns | 700/16 |
| 5,109,222 | A * | 4/1992 | Welty | 340/12.28 |
| 5,877,957 | A * | 3/1999 | Bennett | 700/86 |
| 5,963,624 | A * | 10/1999 | Pope | 379/110.01 |
| 6,021,324 | A * | 2/2000 | Sizer et al. | 455/403 |
| 6,211,796 | B1 * | 4/2001 | Toms et al. | 340/8.1 |
| 6,229,433 | B1 * | 5/2001 | Rye et al. | 340/12.5 |
| 6,400,968 | B1 * | 6/2002 | White et al. | 455/572 |
| 6,567,032 | B1 * | 5/2003 | Mullaly et al. | 341/176 |
| 6,717,528 | B1 * | 4/2004 | Burleson et al. | 340/9.1 |
| 6,856,236 | B2 * | 2/2005 | Christensen et al. | 340/3.5 |
| 6,909,378 | B1 | 6/2005 | Lambrechts et al. | |
| 6,998,955 | B2 | 2/2006 | Ballew et al. | |
| 6,998,997 | B2 | 2/2006 | Stevenson et al. | |
| 7,006,006 | B2 * | 2/2006 | Witkow et al. | 340/4.41 |
| 7,042,366 | B1 * | 5/2006 | Mui et al. | 340/4.41 |
| 7,119,710 | B2 * | 10/2006 | Hayes et al. | 340/12.28 |
| 7,183,940 | B2 * | 2/2007 | Chuey | 340/12.23 |
| 7,209,840 | B2 * | 4/2007 | Petite et al. | 702/62 |

(Continued)

FOREIGN PATENT DOCUMENTS

| | | | |
|---|---|---|---|
| EP | 1942393 | A1 | 9/2008 |
| JP | 2001-025077 | A | 1/2001 |

(Continued)

OTHER PUBLICATIONS

Notice to Grant for Chinese Patent Application No. 201010174433.0, Jan. 15, 2013, 2 pages.

(Continued)

*Primary Examiner* — Jennifer Mehmood
*Assistant Examiner* — Rufus Point
(74) *Attorney, Agent, or Firm* — Kilpatrick Townsend & Stockton LLP

(57) ABSTRACT

Techniques that facilitate the learning and processing of remote control signals by a host device and an accessory. In one set of embodiments, the host device and the accessory can operate in a first mode in which the host device can learn signals from (and thus be remotely operated by) a variety of different remote controls. For example, in some embodiments the host device can learn signals from a remote control that was not specifically designed to interoperate with the host device or the accessory. In another set of embodiments, the host device and the accessory can operate in a second mode in which the host device and the accessory can process learned remote control signals while minimizing the amount of data transferred between the host device and the accessory.

20 Claims, 6 Drawing Sheets

(56) References Cited

U.S. PATENT DOCUMENTS

| | | | | |
|---|---|---|---|---|
| 7,257,398 | B1 * | 8/2007 | Ukita et al. | 455/420 |
| 7,266,344 | B2 * | 9/2007 | Rodriguez | 455/41.3 |
| 7,397,342 | B2 * | 7/2008 | Mullet et al. | 340/5.22 |
| 7,589,642 | B1 * | 9/2009 | Mui | 340/12.3 |
| 2003/0006879 | A1 * | 1/2003 | Kang et al. | 340/5.61 |
| 2004/0203387 | A1 * | 10/2004 | Grannan | 455/41.2 |
| 2004/0239496 | A1 * | 12/2004 | Fitzgibbon | 340/539.1 |
| 2005/0238164 | A1 | 10/2005 | Leung | |
| 2006/0156415 | A1 * | 7/2006 | Rubinstein et al. | 726/27 |
| 2006/0181428 | A1 * | 8/2006 | Blaker et al. | 340/825.22 |
| 2007/0070183 | A1 | 3/2007 | Davis | |
| 2007/0077784 | A1 * | 4/2007 | Kalayjian et al. | 439/61 |
| 2007/0080823 | A1 * | 4/2007 | Fu et al. | 340/825.22 |
| 2007/0230910 | A1 | 10/2007 | Welch | |
| 2007/0288966 | A1 * | 12/2007 | Javid et al. | 725/46 |
| 2008/0057890 | A1 * | 3/2008 | McKillop et al. | 455/185.1 |
| 2008/0092200 | A1 | 4/2008 | Grady et al. | |
| 2008/0320190 | A1 | 12/2008 | Lydon et al. | |
| 2009/0044137 | A1 * | 2/2009 | Bartley et al. | 715/764 |
| 2009/0062947 | A1 * | 3/2009 | Lydon et al. | 700/94 |
| 2009/0322582 | A1 * | 12/2009 | Baugh et al. | 341/176 |
| 2010/0052870 | A1 * | 3/2010 | King | 340/286.02 |
| 2010/0313196 | A1 * | 12/2010 | De Atley et al. | 717/174 |
| 2010/0318586 | A1 * | 12/2010 | Wessling | 707/912 |

FOREIGN PATENT DOCUMENTS

| | | | |
|---|---|---|---|
| JP | 2005-012760 | A | 1/2005 |
| JP | 2006-333349 | A | 12/2006 |
| JP | 2008-523715 | A | 7/2008 |
| WO | 2006/065295 | A1 | 6/2006 |

OTHER PUBLICATIONS

Office Action for Japanese Patent Application No. 2012-509823, Mar. 14, 2013, 4 pages.

Office Action for Korean Patent Application No. 10-2011-7029288, May 14, 2013, 6 pages.

Office Action for Australian Patent Application No. 2010245168, Jun. 17, 2013, 4 pages.

Notice of Allowance for Korean Patent Application No. 10-2011-7029288, Jul. 12, 2013, 2 pages.

Chinese First Office Action, Chinese Application No. 201010174433.0, dated Sep. 20, 2011, 11 pages.

PCT International Search Report and Written Opinion, PCT Application No. PCT/US2010/030293, mailed Jul. 1, 2010, 9 pages.

About Remote Learning on Apple TV, [online], [retrieved from the Internet on Apr. 10, 2009]. <URL: http://support.apple.com/kb/HT3296> 2 pages.

Caster Communications, Inc., Universal® remote control, [online], [retrieved from the Internet on Mar. 31, 2009]. <URL: http://www.castercomm.com/prView.cfm?cid=130&id=252> 1 page.

Murph, URC's PSX-2 iPod dock enables control via universal remote, [online], [retrieved from the Internet on May 8, 2009]. <URL http://www.engadgethd.com/2009/01/28/urcs-psx-2-ipod-dock-enables-control-via-universal-remote> 2 pages.

* cited by examiner

REMOTE CONTROL SIGNAL LEARNING AND PROCESSING BY A HOST DEVICE AND ACCESSORY

BACKGROUND

The present disclosure relates in general to host devices that can interoperate with accessories, and in particular to interoperation of a host device with an accessory to facilitate the learning and processing of signals from a remote control.

Remote control devices (referred to herein as "remote controls") are commonly used to remotely operate various consumer electronic devices such as televisions, DVD players, digital video recorders, and the like. A typical remote control includes one or more buttons and a signal transmitter. When a button of the remote control is activated, the signal transmitter can transmit a signal associated with the button activation event to a signal receiver of a target device to be controlled. The signal can be, for example, a wireless signal such as an infrared (IR) or radio frequency (RF) signal, and can correspond to a function of the target device. When the signal is received at the signal receiver, the signal can be recognized by the target device and the corresponding function can be executed.

In recent years, there has been growing consumer demand for the ability to remotely operate portable media devices. As used herein, a portable media device is a handheld device that is capable of managing and/or playing back media assets such as audio, video, and/or still image files. Some portable media devices, such as the iPod® and iPhone™ (both developed by Apple Inc., assignee of the present application), can provide users a variety of services in addition to media management and playback. Examples of such services include the storage of personal data such as calendar, contacts, and notes; Internet access; mobile telephony; and the ability to selectively download and run various application programs.

To facilitate the remote operation of portable media devices, accessories have been developed that that can interface with a portable media device and receive remote control signals on behalf of the device. These accessories typically have a connector adapted to be docked or mated with a corresponding connector of a portable media device, thereby allowing the exchange of various signals and data between the accessory and the portable media device, and a signal receiver adapted to receive signals from a remote control.

Generally speaking, these existing accessories are designed to recognize a static "vocabulary" of remote control signals and, when a signal in the static vocabulary is received, send an associated command to a connected portable media device. For example, one such existing accessory might be configured to recognize a static signal vocabulary comprising signals A, B, and C that are associated with device commands "PLAY," "FAST FORWARD," and "REWIND" respectively. When signal A is received at the signal receiver of the accessory, the accessory can recognize A as a signal in its static vocabulary and send the "PLAY" command to a connected portable media device. Similarly, when signal B or C is received at the signal receiver of the accessory, the accessory can recognize B or C as a signal in its static vocabulary and send the "FAST FORWARD" or "REWIND" command to the connected portable media device. With this type of implementation, the portable media device can only be controlled by remote controls that are capable of transmitting the specific signals in the static signal vocabulary of the accessory.

BRIEF SUMMARY

Embodiments of the present invention provide techniques that facilitate the learning and processing of remote control signals by a host device (e.g., a portable media device) and an accessory. In one set of embodiments, the accessory can receive a signal from a remote control and send a representation of the signal to the host device. Upon receiving the representation of the signal, the host device can associate the representation with a function of the host device, thereby "learning" that the function should be executed whenever that particular signal is received again from the remote control. In this manner, the host device can be configured to be controlled by a variety of different remote controls, rather than by only specific remote controls that are capable of transmitting a predefined, static vocabulary of signals.

In some cases, the size of the signal representation that is transmitted from the accessory to the host device can be large relative to the bandwidth of the communications channel between the accessory and the host device. If such representations are sent from the accessory to the host device each time a remote control signal is received at the accessory, the communications channel may become saturated to the extent that other data communications between the accessory and the host device via the channel are adversely affected.

Accordingly, certain embodiments of the present invention provide for interoperation between a host device and an accessory that can allow the host device to learn remote control signals as described above, while reducing or minimizing the amount of data transferred between the host device and the accessory when such learned signals are subsequently processed. In one set of embodiments, the host device and the accessory can operate in a first mode for learning remote control signals (referred to herein as "learning mode"). In learning mode, the accessory can receive a signal from a remote control and transmit a representation of the signal to the host device. Upon receiving the representation of the signal, the host device can associate the representation with a function of the host device. In addition, the host device can generate and store an identifier that is associated with the representation and the function. In various embodiments, the identifier can be substantially smaller in size than its associated signal representation. The host device can then transmit the identifier to the accessory, where the identifier is stored with the signal representation.

In a further set of embodiments, the host device and the accessory can operate in a second mode for processing remote control signals (referred to herein as "processing mode"). In processing mode, the accessory can receive a signal from a remote control and determine whether the received signal is substantially similar (or identical) to a previously learned signal. For example, the accessory can compare a representation of the received signal to the signal representations stored while in learning mode. If a substantially similar (or identical) stored signal representation is found, the accessory can transmit the identifier associated with the stored signal representation to the host device. Upon receiving the identifier, the host device can execute the function that was previously associated with the identifier while in learning mode.

By providing for interoperability between a host device and an accessory according to the learning mode described above, certain embodiments of the present invention can enable the host device to learn signals from (and thus be remotely operated by) a variety of different remote controls. For example, in some embodiments the host device can learn signals from a remote control that was not specifically designed to interoperate with the host device or the accessory. Further, by providing for interoperability between a host device and an accessory according to the processing mode described above, certain embodiments of the present invention can enable the host device and the accessory to process learned remote control signals without saturating the communications channel between the host device and the accessory. For example, since the accessory can transmit a relatively small identifier to the host device (rather than an entire signal representation) each time an instance of a learned signal is received, the amount of data transferred between the accessory and the host device can be substantially reduced.

A further understanding of the nature and advantages of the embodiments disclosed herein can be realized by reference to the remaining portions of the specification and the attached drawings.

DETAILED DESCRIPTION

Figure 1:
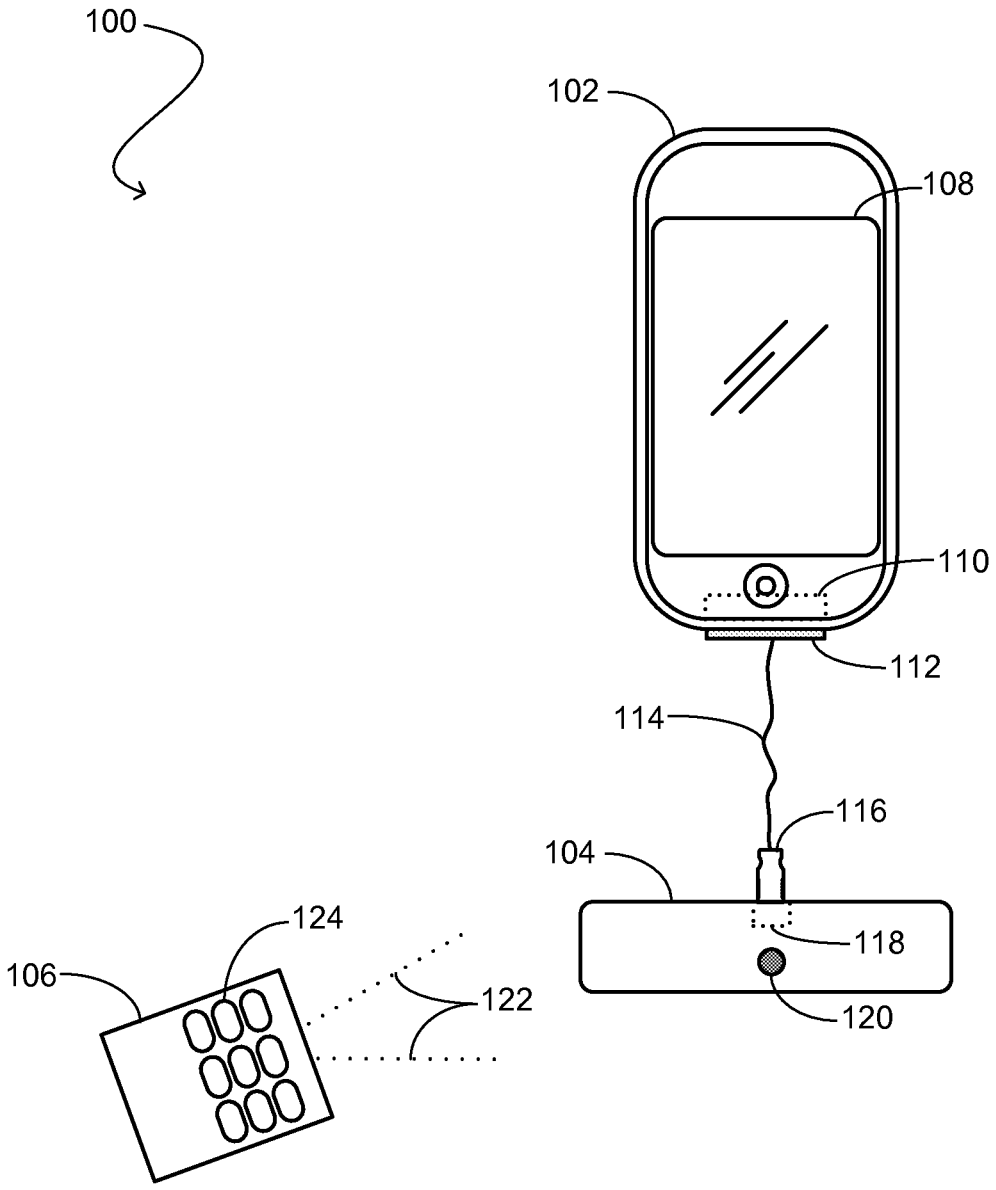
FIG. 1 is a simplified illustration of a system according to an embodiment of the present invention.

In the following description, for the purposes of explanation, numerous details are set forth in order to provide an understanding of various embodiments of the present invention. It will be apparent, however, to one skilled in the art that certain embodiments can be practiced without some of these details.

Embodiments of the present invention provide techniques that facilitate the learning and processing of remote control signals by a host device (e.g., a portable media device) and an accessory. Certain embodiments can allow the host device to learn remote control signals from a variety of different remote controls, while reducing or minimizing the amount of data transferred between the host device and the accessory when such learned signals are subsequently processed.

In one set of embodiments, the host device and the accessory can operate in a first mode for learning remote control signals ("learning mode"). In learning mode, the accessory can receive a signal from a remote control and transmit a representation of the signal to the host device. Upon receiving the representation of the signal, the host device can associate the representation with a function of the host device. In addition, the host device can generate and store an identifier that is associated with the representation and the function. In various embodiments, the identifier can be substantially smaller in size than its associated signal representation. The host device can then transmit the identifier to the accessory, where the identifier is stored with the signal representation.

In a further set of embodiments, the host device and the accessory can operate in a second mode for processing remote control signals ("processing mode"). In processing mode, the accessory can receive a signal from a remote control and determine whether the received signal is substantially similar (or identical) to a previously learned signal. For example, the accessory can compare a representation of the received signal to the signal representations stored while in learning mode. If a substantially similar (or identical) stored signal representation is found, the accessory can transmit the identifier associated with the stored signal representation to the host device. Upon receiving the identifier, the host device can execute the function that was previously associated with the identifier while in learning mode.

By providing for interoperability between a host device and an accessory according to the learning mode described above, certain embodiments of the present invention can enable the host device to learn signals from (and thus be remotely operated by) a variety of different remote controls. For example, in some embodiments the host device can learn signals from a remote control that was not specifically designed to interoperate with the host device or the accessory. Further, by providing for interoperability between a host device and an accessory according to the processing mode described above, certain embodiments of the present invention can enable the host device and the accessory to process learned remote control signals without saturating the communications channel between the host device and the accessory. For example, since the accessory can transmit a relatively small identifier to the host device (rather than an entire signal representation) each time an instance of a learned signal is received, the amount of data transferred between the accessory and the host device can be substantially reduced.

FIG. 1 is a simplified illustration of a system 100 according to an embodiment of the present invention. System 100 includes a host device 102, an accessory 104, and a remote control 106. In one set of embodiments, host device 102 can be a portable media device, such as the iPod® or iPhone™ (both developed by Apple Inc., assignee of the present application). In alternative embodiments, host device 102 can be any other type of electronic device that is capable of interoperating with an accessory device (e.g., accessory 104). Host device 102 can include a user interface comprising user input and/or output devices such as touch-screen display 108. Host device 102 can also include any number of other user input and/or output devices such as scroll wheels, buttons, keyboards, trackballs, touchpads, microphones, speakers, and the like.

Host device 102 can provide a variety of services to a user, such as the management and playback of media assets, mobile telephony and Internet access (e.g., via wireless connections such as Wi-Fi and/or advanced wireless data networks using EDGE or 3G technology), and execution of various application programs that can be installed on host device 102 by the user. Some of these services may call for user input that can be provided directly via an input device of host device 102 (e.g., touch-screen display 108) or remotely via a remote control (e.g., remote control 106).

As shown, host device 102 can include a host connector 110 that can receive an end connector 112 of a cable 114. Host connector 110 can include a number of pins assigned to carry various data and control signals between host device 102 and accessory 104 pertaining to the remote operation of host device 102 by remote control 106. Host connector 110 can also include pins assigned to carry other types of signals, such as audio and/or video signals, as well as pins for providing electrical power and ground connections between host device 102 and accessory 104. In one set of embodiments, a certain pin (or pins) can be assigned to deliver power from host device 102 to accessory 104 while another pin (or pins) can be assigned to deliver power from accessory 104 to host device 102. Thus, either device (102 or 104) can provide power to the other.

Accessory 104 can receive the other end connector 116 of cable 114 at an accessory connector 118. In some embodiments, accessory connector 118 can have a different form factor and/or different number of contacts from host connector 110. In other embodiments, the two connectors can be the same. In still other embodiments, accessory connector 118 can be designed to mate directly with host connector 110 such that cable 114 is not required. In further embodiments, some or all communication between host device 102 and accessory 104 may take place wirelessly (e.g., via Bluetooth or other short-range wireless protocols).

Accessory 104 can be a docking station (also known as a "dock"), a remote control dongle, or any other type of electronic device that is capable of receiving signals from a remote control (e.g., remote control 106) and providing information related to those signals to a connected host device (e.g., host device 102). In one set of embodiments, accessory 104 can include an IR receiver "eye" 120 for receiving IR signals from remote control 106. In other embodiments, accessory 104 can include other types of signal reception components for receiving other types of wireless signals from remote control 106 (e.g., RF signals).

Although not shown, accessory 104 can also include additional components that provide services or service enhancements to host device 102. Merely by way of example, accessory 104 can include audio/video ("A/V") out ports that enable A/V signals to be routed from host device 102 (e.g., via cable 114) to an external display/playback device. Accessory 104 can also include user input and/or output devices, such as scroll wheels, buttons, keyboards, trackballs, touchpads, microphones, speakers, touch-screen displays, and the like for providing user input to, and/or presenting information from, host device 102.

Remote control 106 can be any type of electronic device that is capable of receiving inputs from a user and generating, based on the inputs, one or more signals (e.g., wireless signals 122) for remotely operating a target device (e.g., host device 102). For example, in the embodiment shown remote control 106 includes one or more buttons 124. When a button 124 is activated, remote control 106 can transmit a wireless signal 122 associated with the button activation event to receiver 120 of accessory 104. In various embodiments, accessory 104 and host device 102 can then interoperate in a learning mode or a processing mode to learn or process signal 122.

In some embodiments, remote control 106 may not have been originally designed to interoperate with host device 102 or accessory 104. Remote control 106 may have, for example, come prepackaged with a specific television model and may have been originally designed to only control that television model (or other television models made by the same manufacturer). Using the techniques of the present invention, such proprietary remote controls can nevertheless be used to interoperate with host device 102 and accessory 104.

It should be appreciated that system 100 is illustrative and not intended to limit embodiments of the present invention. For example, a variety of different types of host devices 102, accessories 104, and remote controls 106 can be used. One of ordinary skill in the art will recognize many variations, modifications, and alternatives.

Figure 2:
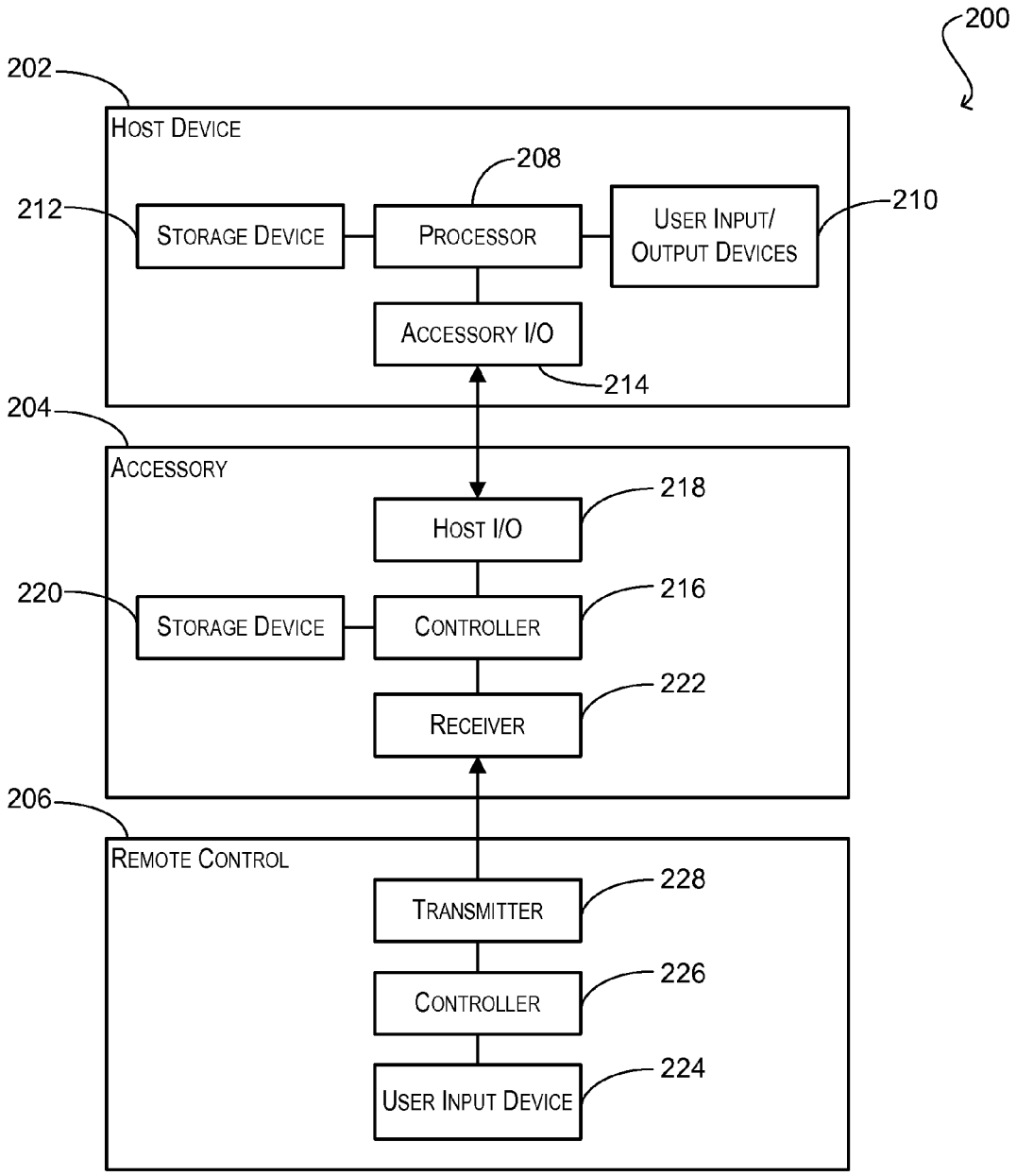
FIG. 2 is a simplified block diagram of a system according to an embodiment of the present invention.

FIG. 2 is a simplified block diagram of a system 200 according to an embodiment of the present invention. As shown, system 200 includes a host device 202, an accessory 204, and a remote control 206. In one set of embodiments, system 200 can implement system 100 of FIG. 1. For example, host device 202 can implement host device 102, accessory 204 can implement accessory 104, and remote control 206 can implement remote control 106.

Host device 202 can include a processor 208, user input/output devices 210, a storage device 212, and an accessory I/O (input/output) interface 214.

Processor 208 can be implemented as one or more integrated circuits, such as a microprocessor or microcontroller. In some embodiments, processor 208 can be a microprocessor that uses the ARM architecture (a RISC architecture designed by ARM Limited). Processor 208 can be responsible for carrying out one or more operations of host device 202. For example, processor 208 can select and play media assets or execute various application programs stored in storage device 212. Processor 208 can also manage communication with accessory devices (e.g., accessory 204) via accessory I/O interface 214. As described in further detail below, in one set of embodiments processor 208 can cause host device 202 to operate in a learning mode or a processing mode to facilitate the learning or processing of remote control signals.

User input/output devices 210 can be any of a number of devices that allow a user to interact with host device 202. For example, as discussed with respect to host device 102 of FIG. 1, such user input/output devices can include scroll wheels, buttons, keyboards, trackballs, touchpads, microphones, speakers, touch-screen displays, and so on. In various embodiments, the user can operate a particular user input device 210 to invoke the functionality of host device 202. In addition, a user can view and/or hear output from host device 202 via a particular user output device 210.

Storage device 212 can be implemented, for example, using magnetic disk, flash memory, and/or any other non-volatile storage medium. In some embodiments, storage device 212 can include non-removable storage components such as non-removable hard disk drive or flash memory drive. In other embodiments, storage device 212 can include removable storage media such as flash memory cards. Storage device 212 can provide storage for any programs and/or data used by host device 202. For example, storage device 212 can store media assets such as audio, video, still images, or the like, and associated metadata (e.g., asset name, artist, title, genre, playlists, etc.). Storage device 212 can also store information other than media assets, such as information about a user's contacts (names, addresses, phone numbers, etc.); scheduled appointments and events; notes; and/or other personal information. In still other embodiments, storage device 212 can store one or more programs to be executed by processor 208, such as video game programs, personal information management programs, programs for playing media assets and/or navigating a media asset database, and so on.

Accessory I/O interface 214 can include a number of signal paths configured to carry various signals between host device 202 and accessory 204. In one set of embodiments, accessory I/O interface 214 includes a 30-pin connector corresponding to the connector used on the iPod® and iPhone™. Alternatively or additionally, accessory I/O interface 214 can include a wireless interface (e.g., Bluetooth or the like).

In some embodiments, host device 202 can also use accessory I/O interface 214 to communicate with a host computer (not explicitly shown) that executes a media asset management program (such as the iTunes® media asset management program distributed by Apple Inc.). In some embodiments, the media asset management program can allow a user to modify a database of media assets stored in storage device 212; to update personal data (e.g., calendar, contacts) stored in storage device 212; and/or to add, update, or remove application programs stored in storage device 212. In other embodiments, host device 202 can include a wireless interface (not explicitly shown) that can provide communication with a host computer and/or a computer network.

Accessory 204 can include a controller 216, a host I/O interface 218, a storage device 220, and a receiver 222.

Controller 216 can be implemented as one or more integrated circuits, such as a microprocessor or microcontroller. In various embodiments, controller 216 can control the operation of accessory 204. Controller 216 can also manage communication with host devices (e.g., host device 202) via host I/O interface 218. As described in further detail below, in one set of embodiments controller 216 can cause accessory 204 to operate in a learning mode or a processing mode to facilitate the learning or processing of remote control signals.

Host I/O interface 218 can include a number of signal paths configured to carry various signals between accessory 204 and host device 202. In one set of embodiments, host I/O interface 218 includes a 30-pin connector corresponding to the connector used on the iPod® and iPhone™. Alternatively or additionally, host I/O interface 218 can include a different connector or a wireless interface (e.g., Bluetooth or the like).

In various embodiments, host I/O interface 218 and accessory I/O interface 214 allow accessory 204 and host device 202 to be in a "connected" or "disconnected" state. As used herein, accessory 204 and host device 202 are connected whenever a communication channel between host I/O interface 218 and accessory I/O interface 214 is open. Conversely, accessory 204 and host device 202 are disconnected whenever the communication channel is closed. Connection can be achieved by physical attachment (e.g., between respective mating connectors of accessory 204 and host device 202), by an indirect connection such as a cable, or by establishment of a wireless communication channel. Similarly, disconnection can be achieved by physical detachment, disconnecting a cable, powering down accessory 204 or host device 202, or closing the wireless communication channel.

A variety of communication channels between host I/O interface 218 and accessory I/O interface 214 can be used, including wired channels such as USB, FireWire, or universal asynchronous receiver/transmitter ("UART"), and wireless channels such as Bluetooth, WiFi, IR, or the like. In some embodiments, multiple communication channels between accessory 204 and host device 202 can be open concurrently. Additionally, host device 202 can be concurrently connected to multiple accessories, with each accessory using a different communication channel.

Storage device 220 can be implemented, for example, using magnetic disk, flash memory, and/or any other non-volatile storage medium. In some embodiments, storage device 220 can include non-removable storage components such as non-removable hard disk drive or flash memory drive. In other embodiments, storage device 220 can include removable storage media such as flash memory cards. Storage device 220 can provide storage for any programs and/or data used by accessory 204. In one set of embodiments, storage device 220 can store representations of remote control signals and data associated with those representations.

Receiver 222 can include one or more signal reception components for receiving signals, such as wireless signals, from a remote control (e.g., remote control 206). In one set of embodiments, receiver 222 can include components, such as an IR diode and an IR demodulator, that are specifically adapted for receiving an IR signal. In these embodiments, the IR diode can capture an IR signal and the IR demodulator can remove the carrier frequency from the captured signal. The output from the IR demodulator (e.g., a square waveform) can then be processed by controller 216 to generate a representation of the IR signal. In alternative embodiments, receiver 222 can include components for receiving other types of signals (e.g., RF signals).

Remote control 206 can include a user input device 224, a controller 226, and a transmitter 228.

User input device 224 can be any of a number of devices that allow a user to provide inputs to remote control 206. For example, such user input devices can include scroll wheels, buttons, keyboards, trackballs, touchpads, microphones, touch-screen displays, and so on. In various embodiments, the user can activate one or more controls on user input device 224 and thereby cause remote control 206 to transmit a signal to a signal receiver (e.g., receiver 222).

Controller 226 can be implemented as one or more integrated circuits, such as a microprocessor or microcontroller. In one set of embodiments, controller 224 can execute program code that causes the controller to process user inputs received via user input device 224 and determine an appropriate signal to be transmitted via transmitter 228.

Transmitter 228 can include one or more signal transmission components for transmitting signals, such as wireless signals, to a signal receiver (e.g., receiver 222). In one set of embodiments, transmitter 228 can include components that are specifically adapted for transmitting an IR signal. In alternative embodiments, transmitter 228 can include components for transmitting other types of signals (e.g., RF signals).

It should be appreciated that system 200 is illustrative and not intended to limit embodiments of the present invention. For example, host device 202, accessory 204, and remote control 206 may each have other capabilities or include other components that are not specifically described. One of ordinary skill in the art will recognize many variations, modifications, and alternatives.

In one set of embodiments, host device 202 and accessory 204 can communicate by exchanging commands and data according to a communications protocol. An example of such a protocol is the iPod® Accessory Protocol (iAP) developed by Apple Inc. According to one aspect, the protocol can define a format for messages transmitted between host device 202 and accessory 204. For instance, the protocol can specify that each message is sent in a packet with a header and an optional payload. The header can provide basic information such as a start indicator, length of the packet, and a command to be processed by the recipient. The payload can provide data associated with the command. In some embodiments, the amount of associated data can be different for different commands, and some commands may provide for variable-length payloads.

According to another aspect, the protocol can define a number of "lingoes," where a "lingo" refers generally to a group of related commands. In one embodiment, a command can be uniquely identified by a first byte identifying the lingo to which the command belongs and a second byte identifying the particular command within the lingo. Other command structures may also be used. It is not required that all accessories, or all host devices to which an accessory can be connected, support every lingo defined within the protocol or every command of a particular lingo (for instance, different devices might use different versions of a given lingo).

In one set of embodiments, the protocol can include a general lingo that enables certain core communication functions between host device 202 and accessory 204. For example, the general lingo can include commands enabling host device 202 and accessory 204 to identify themselves to each other and to provide information about their respective capabilities, including which (if any) other lingoes each supports and which capabilities of the other device each intends to use while connected. The general lingo can also include authentication commands that host device 202 can use to verify the purported identity and capabilities of accessory 204

(or vice versa). In some cases, accessory 204 (or host device 202) can be blocked from invoking certain commands or lingoes if the authentication is unsuccessful.

In further embodiments, the protocol can include one or more accessory lingoes that are used to support communication between a host device and various different classes of accessories. Examples of such accessory lingoes include an RF tuner lingo, a button status lingo, an extended interface lingo, and so on. In a particular embodiment, the protocol can include an accessory lingo that supports interoperation between host device 202 and accessory 204 for learning and processing remote control signals. The commands included in this lingo can generally reflect the operations discussed with respect to FIGS. 3-6 below.

It should be appreciated that the protocol (and associated lingoes and commands) described above is illustrative and not intended to limit embodiments of the present invention. For example, some of the commands can be replaced with other commands or a combination of commands. Further, some of the lingoes and/or commands may not be supported by particular host devices or accessories. One of ordinary skill in the art will recognize many variations, modifications, and alternatives.

As described above, embodiments of the present invention provide techniques that facilitate the learning and processing remote control signals by a host device (e.g., host device 202 of FIG. 2) and an accessory (e.g., accessory 204). In one set of embodiments, the host device and the accessory can operate in a learning mode in which the host device can learn signals from (and thus be remotely operated by) a variety of different remote controls. For example, in some embodiments the host device can learn signals from a remote control that was not specifically designed to interoperate with the host device or the accessory. In another set of embodiments, the host device and the accessory can operate in a processing mode in which the host device and the accessory can process learned remote control signals while minimizing the amount of data transferred between the two devices.

Figure 3:
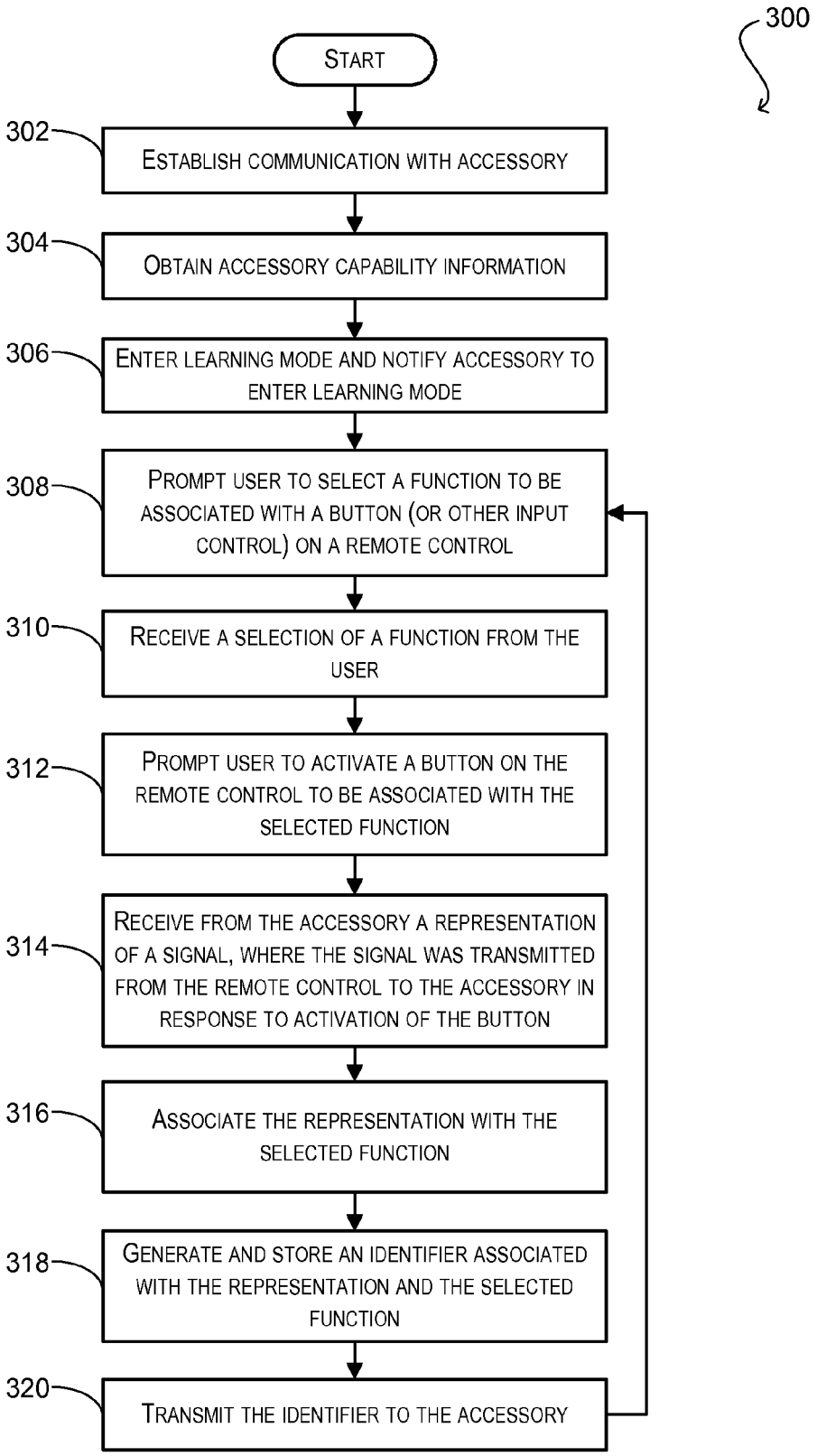
FIG. 3 is a flow diagram of a process performed by a host device while in learning mode according to an embodiment of the present invention.

FIG. 3 is a flow diagram of a process 300 performed by host device 202 while operating in learning mode according to an embodiment of the present invention. Process 300 can be implemented by host device 202 in hardware, software, or a combination thereof. As software, process 300 can be encoded as program code stored on a machine-readable storage medium.

At block 302, host device 202 can establish communication with an accessory (e.g., accessory 204) that is connected to the host device. In one set of embodiments, this can include identifying and authenticating accessory 204 using the general lingo of the communications protocol described above.

At block 304, host device 202 can obtain capability information from accessory 204. For example, host device 202 can obtain information indicating whether accessory 204 includes a receiver for receiving remote control signals, and whether accessory 204 is capable of operating in the learning and processing modes described above. In some embodiments, process 300 can be aborted by host device 202 if accessory 204 does not have these specific capabilities.

At block 306, host device 202 can enter learning mode and notify accessory 204 to enter learning mode. In some embodiments, host device 202 can be manually placed into learning mode by a user of the device. For example, the user can operate an input device of host device 202 (or of accessory 204 or a remote control) in a manner that instructs host device 202 to transition into learning mode. In other embodiments, host device 202 can automatically transition into learning mode upon the occurrence of a predefined event or detection of a predefined status.

Once in learning mode, host device 202 can generate one or more user interfaces designed to guide the user in associating remote control signals with functions of the host device. For example, at block 308 host device 202 can generate a first user interface prompting the user to select a particular function to be associated with a button (or other input control) on the user's remote control (e.g., remote control 206). Specifically, the first user interface can present a list of functions and allow the user to select a function from the list. In some embodiments, the list of selectable functions can be static. In other embodiments, the list of selectable functions can vary based on an application context of host device 202. For instance, if learning mode is entered while host device 202 is running a media player application, the list of selectable functions can include "PLAY," "STOP," "REWIND," "FAST FORWARD," and/or other functions that are typically used when playing back media assets. As another example, if learning mode is entered while host device 202 is running a Web browser application, the list of selectable functions can include "HOME," "BACK," FORWARD," "REFRESH," and/or other functions that are typically used to navigate Web pages.

At block 310, host device 202 can receive a selection of a function from the user. Host device 202 can then generate a second user interface prompting the user to activate a button on remote control 206 that should be associated with the selected function (block 312). In various embodiments, process 300 can wait at block 312 until the user activates a button on remote control 206. In some cases, if the user does not activate a button within a predetermined period of time, a time-out message can be displayed to the user and the process can return to block 308.

It should be appreciated that the user interfaces described at blocks 308 and 312 are exemplary and can be modified in various ways. For example, in some embodiments host device 202 may not need to prompt the user to select a particular function per block 308; rather, host device 202 can simply the prompt the user to activate a remote control button for each function in the list of functions in a sequential order. Further, the user interfaces can be presented to the user in a number of different ways. For instance, in one embodiment the user interfaces can be presented visually to the user via a display on host device 202, such as touch-screen display 108 shown in FIG. 1. In another embodiment, the user interfaces can be presented visually to the user via an external display device that is communicatively coupled with host device 202 or accessory 204. In yet another embodiment, the user interfaces can be presented aurally to the user via, e.g., a speaker incorporated in host device 202, accessory 204, or an external enclosure.

Once the user has activated a remote control button in response to the prompt at block 312, a signal corresponding to the button activation event can be transmitted from remote control 206 to accessory 204. Host device 202 can then receive a representation of the signal from accessory 204 and associate the representation with the selected function (blocks 314 and 316). In this manner, host device 202 can learn that the selected function should be executed whenever that particular signal is transmitted again from remote control 206 (while host device 202 is in processing mode).

The signal representation received from accessory 204 at block 314 can take a number of different forms, and can vary based on the type of signal transmitted by remote control 206 and/or the implementation of accessory 204. For example, if the signal is an IR signal, the representation can comprise a sequence of edge times or time samples encoding a waveform (e.g., a square wave) of the IR signal, or an IR protocol type of the IR signal and an associated protocol command or data string. Other types of signal representations (e.g., as known in the art) may also be implemented and used.

At block 318, host device 202 can generate an identifier associated with the representation and the selected function. Alternatively, host device 202 can select the identifier from a predefined list of identifiers. The generated or selected identifier can then be stored. In one set of embodiments, the identifier can be substantially smaller in size than its associated signal representation. As described above (and as described in greater detail with respect to FIGS. 5 and 6 below) the relatively small size of the identifier can facilitate the processing of learned remote controls signals by host device 202 and accessory 204 while reducing or minimizing the amount of data transferred between the two devices.

At block 320, host device 202 can transmit the identifier to accessory 204. Process 300 can then return to block 308; for example, host device 202 can prompt the user to select another function to be associated with a button on remote control 206. Process 300 can continue indefinitely until, for example, host device 202 and accessory 204 become disconnected, or until the user instructs host device 202 to exit from learning mode.

Figure 4:
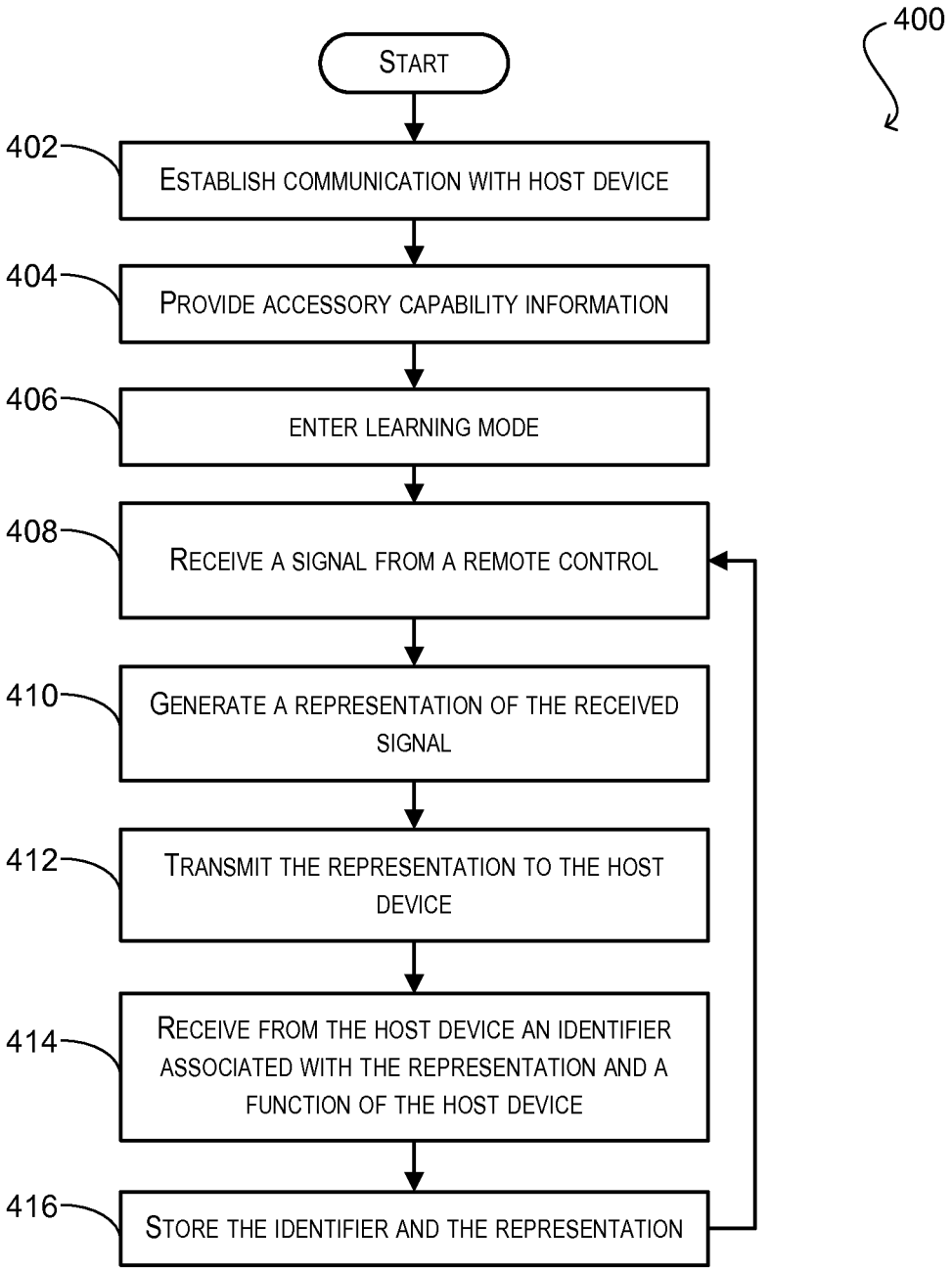
FIG. 4 is a flow diagram of a process performed by an accessory while in learning mode according to an embodiment of the present invention.

FIG. 4 is a flow diagram of a process 400 performed by accessory 204 while in learning mode according to an embodiment of the present invention. In one set of embodiments, process 400 can be performed by accessory 204 while process 300 is being performed by host device 202. Process 400 can be implemented by accessory 204 in hardware, software, or a combination thereof. As software, process 400 can be encoded as program code stored on a machine-readable storage medium.

At block 402, accessory 204 can establish communication with a host device (e.g., host device 202) that is connected to the accessory. In one set of embodiments, this can include identifying and authenticating host device 202 using the general lingo of the communications protocol described above.

At block 404, accessory 204 can provide capability information to host device 202. For example, accessory 204 can indicate whether it includes a receiver for receiving remote control signals, and whether it is capable of operating in the learning and processing modes described above. In some embodiments, process 400 can be aborted by host device 202 or accessory 204 if accessory 204 does not have these specific capabilities.

At block 406, accessory 204 can enter learning mode. In one set of embodiments, accessory 204 can enter learning mode in response to a command from host device 202 (e.g., the notification command sent at block 306 of process 300). Alternatively, accessory 204 can be manually placed into learning mode by a user, or automatically transition into learning mode upon the occurrence of a predefined event or detection of a predefined status.

Once in learning mode, accessory 204 can receive a signal from a remote control such as remote control 206 (block 408). As described above with respect to process 300, the received signal can correspond to a button activation event that is initiated by a user in response to the prompt presented at block 312.

At block 410, accessory 204 can process the received signal and generate a representation of the signal. For example, if the signal is an IR signal, the representation can comprise a sequence of edge times or time samples encoding a waveform of the IR signal, or an IR protocol type and associated protocol command or data string of the IR signal. Other types of signal representations (e.g., as known in the art) may also be generated and used.

Once the representation is generated, accessory 204 can transmit the representation to host device 202 (block 412). Thus, host device 202 can be made aware that the signal has been received from remote control 206 and should be associated with the function selected by the user at block 310.

At block 414, accessory 204 can receive from host device 202 an identifier that is associated with the representation and the selected function. In various embodiments, this identifier corresponds to the identifier generated by host device 202 at block 318. Accessory 204 can then store the identifier and the representation of the signal (block 416). As described in greater detail with respect to FIGS. 5 and 6 below, this stored identifier/representation information can be used by accessory 204 in processing mode to determine when the same signal is received again and to notify host device 202 accordingly.

Once the identifier and representation have been stored, process 400 can return to block 408. For example, accessory 204 can receive another signal from remote control 206 that should be learned. Process 400 can continue indefinitely until, for example, host device 202 and accessory 204 become disconnected, or until the user instructs host device 202 (or accessory 204) to exit from learning mode.

It will be appreciated that processes 300 and 400 are illustrative and that variations and modifications are possible. Steps described as sequential may be executed in parallel, order of steps may be varied, and steps may be modified, combined, added, or omitted. For example, in some embodiments host device 202 can transmit a second representation of the remote control signal to accessory 204 at block 320 of process 300. This second representation may or may not be identical to the first representation received by host device 202 from accessory 204 at block 314. Accessory 204 can then store the second representation with the identifier at block 416 of process 400.

By transmitting this second representation, host device 202 can, in some embodiments, provide additional details to accessory 204 on how to determine whether that particular signal is received again when in processing mode. For example, the second representation can include error tolerance information indicating an error tolerance for comparing representations of newly received signals to the second representation. If the difference between the two representations is within the specified tolerance, accessory 204 can deem the two representations to be identical and notify host device 202 to that effect.

Figure 5:
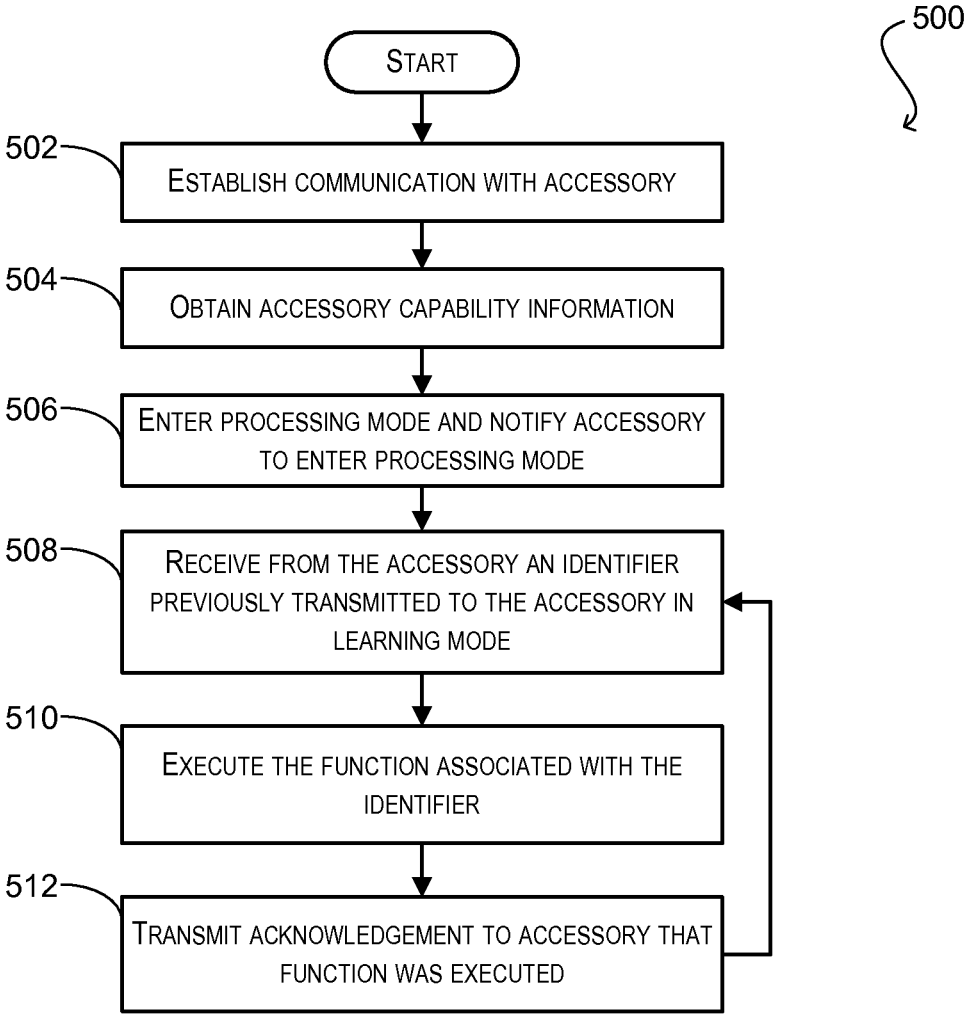
FIG. 5 is a flow diagram of a process performed by a host device while in processing mode according to an embodiment of the present invention.

FIG. 5 is a flow diagram of a process 500 performed by host device 202 while operating in processing mode according to an embodiment of the present invention. Process 500 can be implemented by host device 202 in hardware, software, or a combination thereof. As software, process 500 can be encoded as program code stored on a machine-readable storage medium.

At blocks 502 and 504, host device 202 can establish communication with an accessory (e.g., accessory 204) and obtain capability information from the accessory in a manner similar to blocks 302 and 304 of process 300.

At block 506, host device 202 can enter processing mode and notify accessory 204 to enter processing mode. In some embodiments, host device 202 can be manually placed into processing mode by a user of the device. For example, the user can operate an input device of host device 202 (or of accessory 204 or a remote control) in a manner that instructs host device 202 to transition into processing mode. In other embodiments, host device 202 can operate in processing mode by default if it is not operating in learning mode.

At block 508, host device 202 can receive from accessory 204 an identifier that was previously transmitted to the accessory in learning mode (e.g., at block 320 of process 300). Generally speaking, the receipt of this identifier indicates that the remote control signal associated with the identifier in learning mode has now been received again by accessory 204 in processing mode. It should be appreciated that accessory 204 does not need to transmit the representation of the associated signal with the identifier at block 508; rather transmission of the identifier alone is sufficient for host device 202 to recognize which signal has been received by accessory 204. Upon receiving the identifier, host device 202 can execute the function associated with the identifier (block 510).

In some embodiments, host device 202 can transmit an acknowledgement to accessory 204 indicating that the function has been executed (block 512). Process 500 can then return to block 508; for example, host device 202 can receive from accessory 204 additional identifiers corresponding to the additional remote control signals. Process 500 can continue indefinitely until, for example, host device 202 and accessory 204 become disconnected, or until the user instructs host device 202 to exit from processing mode.

Figure 6:
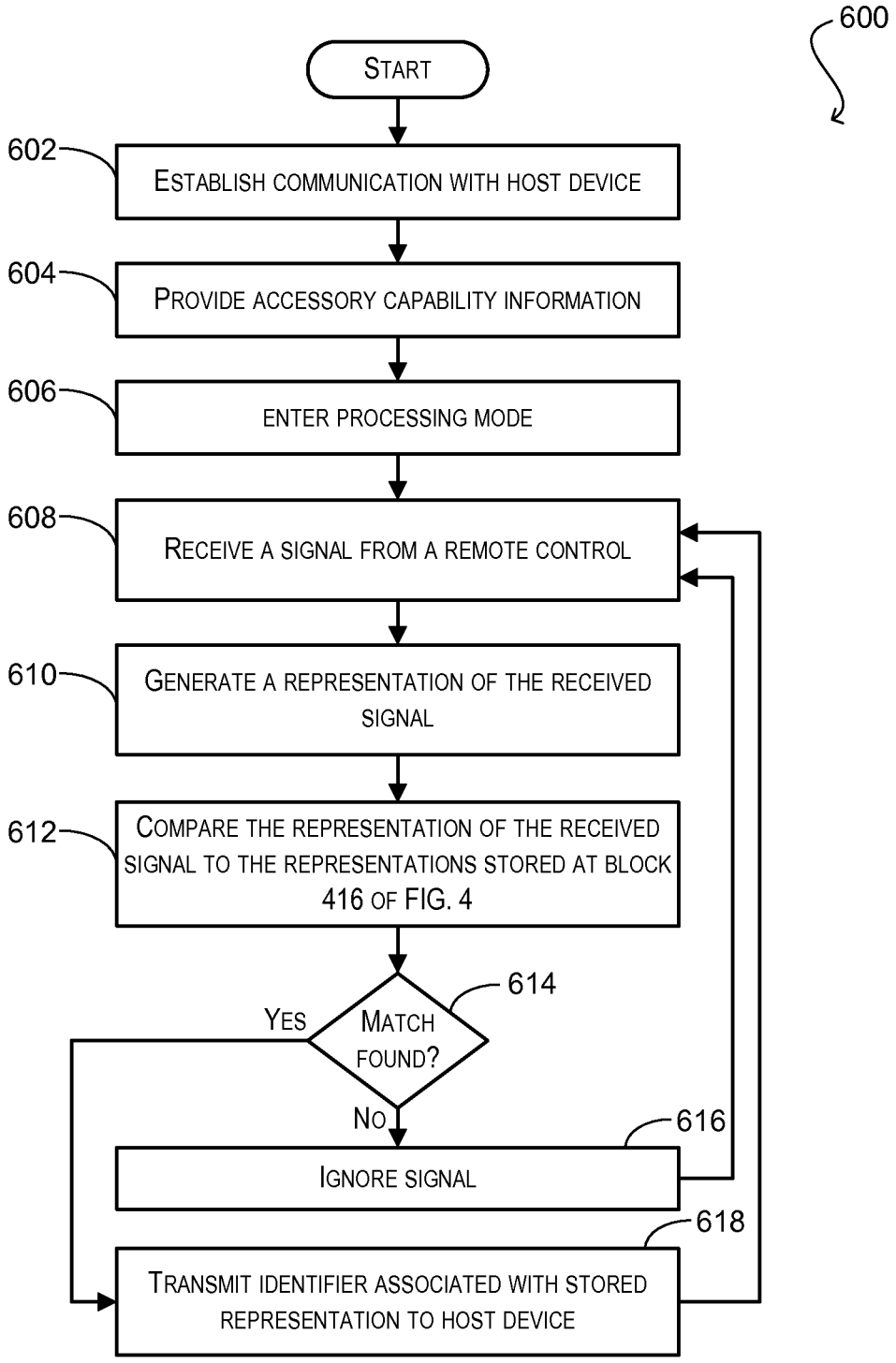
FIG. 6 is a flow diagram of a process performed by an accessory while in processing mode according to an embodiment of the present invention.

FIG. 6 is a flow diagram of a process 600 performed by accessory 204 while operating in processing mode according to an embodiment of the present invention. In one set of embodiments, process 600 can be performed by accessory 204 while process 500 is being performed by host device 202. Process 600 can be implemented by accessory 204 in hardware, software, or a combination thereof. As software, process 600 can be encoded as program code stored on a machine-readable storage medium.

At blocks 602 and 604, accessory 204 can establish communication with a host device (e.g., host device 202) and provide capability information to the host device in a manner similar to blocks 402 and 404 of process 400.

At block 606, accessory 204 can enter processing mode. In one set of embodiments, accessory 204 can enter processing mode in response to a command from host device 202 (e.g., the notification command sent at block 506 of process 500). Alternatively, the accessory can be manually placed into processing mode by a user, or can operate in processing mode by default if it is not operating in learning mode.

Once in processing mode, accessory 204 can receive a signal from a remote control such as remote control 206 (block 608). In various embodiments, the signal can correspond to a button activation event that is initiated by a user in order to execute a function previously associated with the button (e.g., in learning mode). Accessory 204 can then generate a representation of the received signal and compare that representation with the representations stored at block 416 of process 400 (blocks 610 and 612). In this manner, accessory 204 can determine whether the received signal is identical (or substantially similar) to a previously learned remote control signal.

If a stored signal representation matching the representation of the received signal is found, accessory 204 can transmit the identifier associated with the stored representation to host device 202 (blocks 614 and 618). Thus, accessory 204 can notify host device 202 that the function associated with the identifier should be executed. Since accessory 204 only needs to transmit the relatively small identifier to host device 202 (rather than an entire signal representation), the amount of data transferred between the accessory and host device can be relatively low. Accordingly, accessory 204 and host device 202 can process learned remote control signals per processes 500 and 600 without saturating the communications channel between the two devices.

If no stored signal representation matching the representation of the received signal is found, accessory 204 can simply ignore the signal (blocks 614 and 616). In some embodiments, accessory 204 can indicate to the user that the signal was ignored (e.g., display an error symbol or light, generate an audible tone, etc.). In either case (block 616 or block 618), process 600 can return to block 608. For example, accessory 204 can receive another signal from remote control 206 for processing. Process 600 can continue indefinitely until, for example, host device 202 and accessory 204 become disconnected, or until the user instructs host device 202 (or accessory 206) to exit from processing mode.

It will be appreciated that processes 500 and 600 are illustrative and not intended to limit embodiments of the present invention. Steps described as sequential may be executed in parallel, order of steps may be varied, and steps may be modified, combined, added, or omitted.

While the invention has been described with respect to specific embodiments, one skilled in the art will recognize that numerous modifications are possible. In some embodiments, circuits, processors, and/or other components of a host device and/or accessory may be configured to perform various operations described herein. Those skilled in the art will appreciate that, depending on implementation, such configuration can be accomplished through design, setup, interconnection, and/or programming of the particular components and that, again depending on implementation, a configured component might or might not be reconfigurable for a different operation. For example, a programmable processor can be configured by providing suitable executable code; a dedicated logic circuit can be configured by suitably connecting logic gates and other circuit elements; and so on. Further, while the embodiments described above may make reference to specific hardware and software components, those skilled in the art will appreciate that different combinations of hardware and/or software components may also be used and that particular operations described as being implemented in hardware can also be implemented in software or vice versa.

Computer programs incorporating some or all features described herein may be encoded on various machine-readable storage media; suitable media include magnetic disk (including hard disk) or tape, optical storage media such as compact disk (CD) or DVD (digital versatile disk), flash memory, and the like. Machine-readable storage media encoded with the program code may be packaged with a compatible device or provided separately from other devices. In addition, program code may be encoded and transmitted via wired, optical, and/or wireless networks conforming to a variety of protocols, including the Internet, thereby allowing distribution, e.g., via Internet download.

Thus, although the invention has been described with respect to specific embodiments, it will be appreciated that the invention is intended to cover all modifications and equivalents within the scope of the following claims.

What is claimed is:

1. A method comprising:

receiving, at an accessory, a first wireless signal from a remote control device;

transmitting, from the accessory, a representation of the first wireless signal to a host device operable to execute a plurality of functions;

receiving, at the accessory in response to transmitting the representation of the first wireless signal to the host device, an identifier from the host device, the identifier being associated with the representation of the first wireless signal and one of the plurality of functions of the host device, the one of the plurality of functions having been selected by a user of the host device;

storing, at the accessory, the identifier received from the host device; and storing, at the accessory, the representation of the first wireless signal transmitted to the host device by the accessory in association with the stored identifier.

2. The method of claim 1 further comprising:

receiving, at the accessory, a second wireless signal from the remote control device;

determining, based on the stored representation of the first wireless signal, if the second wireless signal is substantially similar to the first wireless signal; and if the second wireless signal is substantially similar to the first wireless signal, transmitting the identifier to the host device.

3. The method of claim 1 wherein the first wireless signal is an infrared (IR) signal, and wherein the representation comprises: time samples that encode a waveform of the IR signal, a sequence of edge times that encode a waveform of the IR signal, or an IR protocol type and associated protocol command string of the IR signal.

4. The method of claim 1 wherein the remote control device is designed to control a device other than the accessory and the host device.

5. The method of claim 1 wherein the host device is a portable media device and wherein the accessory is a portable media device dock.

6. A method comprising:

receiving, at a host device operable to execute a plurality of functions, a representation of a wireless signal from an accessory, the wireless signal having been transmitted to the accessory from a remote control device;

receiving a selection of one of the plurality of functions of the host device;

associating, by the host device, the representation of the wireless signal with the selected function of the host device;

generating, by the host device, an identifier associated with both the representation of the wireless signal and the selected function of the host device; and transmitting, by the host device, the identifier to the accessory.

7. The method of claim 6 further comprising storing the identifier and information representing the selected function.

8. The method of claim 6 further comprising:

receiving, at the host device, the identifier from the accessory; and executing the selected function in response to receiving the identifier.

9. The method of claim 8 further comprising transmitting, by the host device, an acknowledgement to the accessory indicating that the selected function has been executed.

10. The method of claim 8 wherein the wireless signal was transmitted from the remote control device to the accessory in response to an activation of a button on the remote control device by a user.

11. An accessory comprising:

a wireless receiver configured to receive wireless signals from a remote control device;

an interface configured to communicate with a host device; and a control component coupled to the wireless receiver and the interface and configured to:

receive, using the wireless receiver, a wireless signal from the remote control device;

transmit, to the host device, a characteristic of the wireless signal received by the wireless receiver;

receive, from the host device, an identifier associated with both the characteristic of the wireless signal and a function of the host device;

store the identifier in association with the characteristic of the wireless signal; and transmit the identifier to the host device when a subsequent wireless signal is received having the characteristic.

12. The accessory of claim 11 wherein the steps of transmitting the characteristic of the wireless signal and receiving the identifier are performed by the control component while the control component is operating in a first mode, and wherein the step of transmitting the identifier is performed by the control component while the control component is operating in a second mode distinct from the first mode.

13. The accessory of claim 12 wherein the control component is instructed to enter the first and second modes respectively by the host device.

14. A host device operable to execute a plurality of functions, the host device comprising:

an interface configured to communicate with an accessory; and a processor coupled to the interface and configured to:

receive, from the accessory via the interface, a characteristic of a wireless signal;

receive a selection of one of the plurality of functions of the host device;

transmit, to the accessory, an identifier associated with both the characteristic of the wireless signal and the selected function of the host device;

subsequently to transmitting the identifier, receive the identifier from the accessory; and execute the selected function in response to receiving the identifier.

15. The host device of claim 14 wherein the step of transmitting the identifier is performed by the processor while the processor is operating in a first mode, and wherein the steps of receiving the identifier and executing the selected function are performed by the processor while the processor is operating in a second mode distinct from the first mode.

16. The host device of claim 15 wherein the processor is configured to enter the first and second modes respectively based on user input.

17. A method comprising:

entering, by a host device, a first mode of operation;

transmitting, by the host device, a command to an accessory instructing the accessory to enter the first mode of operation; and while in the first mode of operation:

prompting, by the host device via a user interface of the host device, a user to select a function of the host device from a list of selectable functions;

receiving, by the host device, a selection of a function from the user;

prompting, by the host device via the user interface of the host device, the user to activate a button on a remote control device to be associated with the selected function;

receiving, by the host device, a representation of a wireless signal from the accessory, wherein the wireless signal was transmitted from the remote control device to the accessory in response to activation of the button;

generating, by the host device, an identifier associated with both the representation and the selected function; and transmitting, by the host device, the identifier to the accessory.

18. The method of claim 17 further comprising:

entering, by the host device, a second mode of operation distinct from the first mode of operation;

transmitting, by the host device, a command to the accessory instructing the accessory to enter the second mode of operation; and while in the second mode of operation:

receiving, by the host device, the identifier from the accessory; and executing, by the host device, the selected function in response to receiving the identifier.

19. The method of claim 17 wherein the list of selectable functions is static.

20. The method of claim 17 wherein the list of selectable functions varies based on an application context of the host device at a time the first mode of operation is entered.

* * * * *